US005245745A

United States Patent [19]

Jensen et al.

[11] Patent Number: 5,245,745

[45] Date of Patent: Sep. 21, 1993

[54] METHOD OF MAKING A THICK-FILM PATCH ANTENNA STRUCTURE

[75] Inventors: Paul C. Jensen, Broomfield; David W. Paananen, Lafayette, both of Colo.

[73] Assignee: Ball Corporation, Muncie, Ind.

[21] Appl. No.: 799,264

[22] Filed: Nov. 27, 1991

Related U.S. Application Data

[63] Continuation of Ser. No. 551,206, Jul. 11, 1990, abandoned.

[51] Int. Cl.[5] ..... H01P 11/00

[52] U.S. Cl. ..... 29/600; 343/700 MS

[58] Field of Search ..... 29/600; 343/700 MS

[56] References Cited

U.S. PATENT DOCUMENTS 4,609,892 9/1986 Higgins, Jr. ..... 29/600 X

FOREIGN PATENT DOCUMENTS 2-88407 3/1990 Japan .

OTHER PUBLICATIONS

NTZ Nachrichtentechnische Zeitschrift, NTZ Communications Journal vol. 28 No. 5 May 1975, pp. 156–159 by W. Wiesbeck.

Electronics Letters vol. 15 No. 15 Jul. 19, 1979, pp. 458–459 by Hall et al.

*Primary Examiner*—Carl J. Arbes

*Attorney, Agent, or Firm*—Gilbert E. Alberding

[57] ABSTRACT

Method and structure are disclosed for production of a thick-film antenna. A thick-film microwave patch element (26) is patterned onto one surface of a dielectric substrate (32) and a thick-film reference surface (24) disposed onto the opposite surface. The patch element may be placed in different locations on the substrate relative to the feed hole to adjust the impedance and resonant frequency of the antenna before it has been dried and fired while tuning tabs (30) may abut the patch element for use in adjusting the impedance and resonant frequency of the antenna (20) after it has been dried and fired. In one embodiment, the substrate (24) is a ceramic material having an alumina content of about 96%. A multiple-frequency antenna can be created by stacking patch elements and dielectric layers above the reference surface.

35 Claims, 7 Drawing Sheets

$\theta = 75°$
$\Phi = VAR.$

METHOD OF MAKING A THICK-FILM PATCH ANTENNA STRUCTURE

RELATED APPLICATION

This application is a continuation of copending U.S. patent application Ser. No. 07/551,206 by Jensen et al., filed Jul. 11, 1990, and entitled "THICK-FILM PATCH ANTENNA STRUCTURE AND METHOD" now abandoned.

TECHNICAL FIELD OF THE INVENTION

This invention is directed to an antenna structure, and a method of construction therefor, and more particularly to single and multiple frequency, thick-film patch antennas which preferably comprise a ceramic substrate and are capable of broadband, low-angle gain operation.

BACKGROUND OF THE INVENTION

The applications for antennas continue to increase as antenna sizes are reduced and complimentary broadband microwave designs are developed. In this regard, the evolution of thin-film "patch", or microstrip, antennas has been particularly important. Chapter 7 of R. Johnson & H. Jasik, *Antenna Engineering Handbook* (2d ed. 1984) provides an excellent discussion of such antennas.

In the production of thin-film patch antennas, a dielectric substrate is typically coated on both sides with a thin film of metal (i.e., less than 0.5 mil), or alternatively, a thin metal foil is laminated to the opposing sides of the substrate. Using conventional photolithographic/ etching techniques, the metal on one side is then selectively removed to yield a high-resolution patch of a desired configuration. The metal on the other size serves as a ground plane for microwave transmission/reception.

In order to satisfy broadband and other signal requirements for many expanding applications, it is essential for thin-film patch antenna substrates to comply with extremely tight flatness, thickness and dielectric range tolerances and/or to implement extensive tuning networks. This is due, in large part, to the fact that the thin metal patch cannot readily be adapted, or tuned, to compensate for substrate deviations. To achieve flatness, thickness and dielectric constant range requirements, substrate production processes must be tailored and closely controlled, and substrate preconditioning (i.e., grinding) may be necessary. As will be appreciated by those skilled in the art, such demands, coupled with the attendant labor/equipment demands of photoetching techniques, render thin-film patch antennas impractical from a cost standpoint for many potential antenna applications.

For example, to realize the full potential of Global Positioning Systems (GPS), the need for low-cost receivers for truck fleets, surveying and navigation equipment, etc. is particularly acute. While high-resolution patches can be configured by the noted thin-film production techniques to meet the broadband, low-angle gain needs of GPS receivers for $L_1$ and $L_2$ band operations (centered on approximately 1.575 GHz and 1.227 GHz, respectively), attendant costs preclude widespread application. Cost considerations are further compounded when ceramic substrates are considered. That is, while ceramic substrates can provide high dielectric constants (e.g., as high as 9 to 10), thereby permitting antenna size reduction, the costs associated with satisfying substrate flatness, thickness and dielectric constant tolerances become prohibitive. In view of the foregoing, thin-film patch antennas have been unable to meet the needs of many potential applications and have failed to capitalize on ceramic-related benefits for GPS or other similar applications.

SUMMARY OF THE INVENTION

Accordingly, a primary objective of the present invention is to provide a cost-effective patch antenna.

More particularly, an objective of the invention is to provide a patch antenna producible by substantially additive processing only.

A further objective of the present invention is to provide a patch antenna wherein, by virtue of the thickness, positioning, and tuning of a metal patch on a substrate, substrate-related costs may be substantially reduced.

Another objective of the present invention is to provide a cost-effective patch antenna capable of broadband, low-angle gain operation suitable for GPS and similar applications.

A further objective of the invention is to provide a cost-effective patch antenna that employs a ceramic substrate for size reduction.

Another objective of the present invention is to provide a cost-effective patch antenna capable of multiple frequency operations such as dual frequency GPS applications in the $L_1$ and $L_2$ bands.

To achieve the foregoing objectives, the present invention utilizes a thick-film metal patch (i.e., 0.5 mil to approximately 5 mil), patterned on one surface of a dielectric substrate and a conducting reference surface on the opposing side, to yield a novel, thick-film patch antenna. Of importance, the thick-film patch can be acceptably patterned/positioned directly upon application, thereby avoiding subtractive processing (e.g. photoetching) and reducing substrate demands.

That is, by employing and properly patterning/positioning, as necessary, a thick-film patch relative to a substrate feed hole, a cost-effective antenna displaying an acceptable impedance match can be obtained, and broadband, low-angle gain characteristics can be realized such as, for example, for GPS operations in the $L_1$ and/or $L_2$ bands. More particularly, and contrary to conventional thinking, by locating the feed hole asymmetrically relative to the zero reactance axis of the patch (e.g. off the diagonal of a rectangular patch), as necessary, the impedance of the patch at the feed hole location can be acceptably matched to the impedance of an interconnected RF transmitting means.

The compensable nature of the thick-film patch and the noted patch placement technique serve to reduce substrate flatness and dielectric range requirements, and therefore accommodate use of readily available, lower cost substrates. This is of particular benefit in a preferred embodiment where a ceramic substrate is utilized for size reduction.

In one embodiment of the present invention, the metal patch can also be tuned after being patterned onto the substrate. Tuning tabs, disposed of the perimeter of the patch, are printed on the dielectric material with the patch element. The tabs can be trimmed in order to adjust the frequency of operation, the impedance match and the polarization of the antenna structure. Thus, small but significant changes in the dielectric constant of different batches of readily available, less expensive substrates (e.g. ceramic substrates) can be offset by trimming the tuning tabs. Similarly, impedance adjustments necessitated by the use of a radome can also be readily made.

In a further embodiment, multiple frequencies, such as the $L_1$ and $L_2$ bands used for GPS applications, can be accommodated within the same antenna structure. In such embodiments, thick-film patch antennas of the aforesaid nature ar "stacked" one on top of the other. As will be further explained, it is desirable to provide a larger metal patch on the bottom component than the top component. In one arrangement, ceramic substrates having substantially the same dielectric properties are employed together with a bonding composition that is loaded with a high-dielectric material to yield a composition whose dielectric properties are substantially the same as the ceramic substrates. Various conventional methods can be used to couple the inventive antenna with the receiver or transmitter. Similarly, various methods can be used to accommodate variously polarized signals. In the preferred embodiment for GPS applications, however, the antenna feed is a single coaxial connection located at such a position as to properly receive the right-hand circularly polarized signals from the GPS satellites.

BRIEF DESCRIPTION OF THE DRAWINGS

For a more complete understanding of the present invention, and the advantages thereof, reference will be made in the following description to the accompanying drawings, in which.

DETAILED DESCRIPTION OF THE INVENTION

Figure 1:
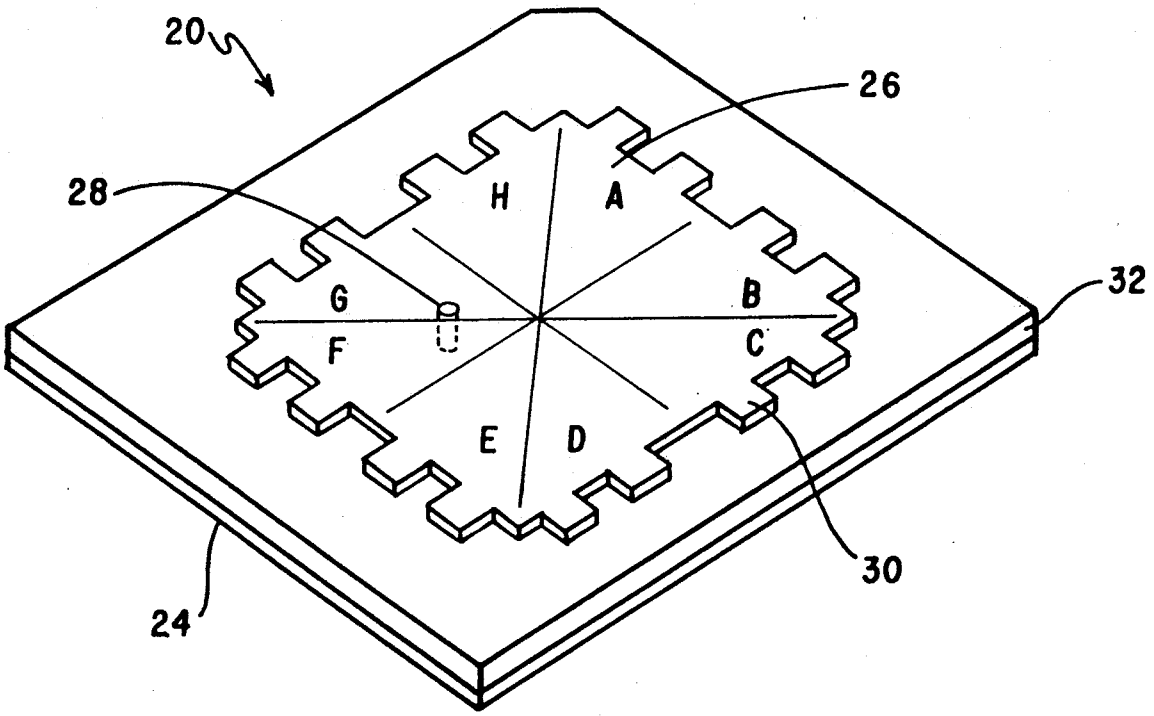
FIG. 1 illustrates a single frequency antenna of the present invention.

Existing thin-film patch antennas comprise a dielectric material which has an electrically conductive reference surface disposed on one surface and a second, generally smaller, electrically conductive metallization disposed on the opposite surface. The antenna may be coupled to an RF circuit using any of several conventional methods of transmission such as a coaxial cable or a microstrip feed line. As may be appreciated by those skilled in the art, the impedance of a patch antenna is different at different locations on the patch. Traditionally, matching the impedance of a thin-film patch to a coaxial cable entailed locating the feed on the zero reactance axis of the patch. For example, the feed hole of a rectangular patch would be located on the diagonal between two opposite corners of the patch and some distance from the physical center of the patch.

The dielectric layer of such thin-film antennas is commonly a material with a relatively low dielectric constant (e.g. approximately $K=2$ to 3), such as a Teflon-fiberglass combination. Traditionally, efforts have been made to utilize materials having dielectric constants as close to that of the free space (e.g. approximately $K=1.0$ for air) into which the antenna radiates in order to achieve as ideal a match as possible and minimize energy losses.

To construct a thin-film patch antenna, the dielectric layer is metallized with a thin film on both surfaces. Using conventional methods, portions of the metal on one surface are photoetched to obtain an antenna patch element whose shape and dimensions are appropriate for RF signals of a desired frequency and polarization. Although, the resolution of the resulting thin-film metallization can be very high, the thin-film process tends to be expensive for a number of reasons. First, both surfaces of the substrate must be metallized in a very precise and controlled manner to achieve a uniform depth (e.g. using such techniques as sputtering or vapor deposition), which is time consuming and equipment intensive. Second, parts of the metallizations are chemically removed in a subtractive process. Besides being time-consuming and wasting the etched metal, subtractive processing yields a residue which is hazardous and must be properly disposed of. Third, the substrate surface must be extremely flat in order to reduce losses which occur when the thin metallization must follow an irregular surface topography. Fourth, due to the sensitivity of the thin-film patch, the substrate must conform to the tight dielectric constant ranges. For readily available substrates, including ceramic substrates, overcoming the third problem often requires that the substrate be preconditioned, i.e., ground flat before the application metallization; and overcoming the fourth problem often requires the use of a high alumina content ceramic material, both of which demands add substantially to the cost of production.

Once the metallized thin-film patch element has been etched, it is very difficult to make accurate patch adjustments due to the sensitive nature of the thin structure. Such adjustments might be required if, for example, the antenna is to be covered with a radome which, having its own dielectric constant, may affect the impedance match of the antenna. As such, extensive tuning networks have often been employed in combination with thin-film antenna feed systems, adding to the size, weight, complexity and expense of the antenna.

FIG. 1 illustrates a single frequency antenna of the present invention, generally indicated as 20. A dielectric layer 22 has a ground plane reference surface 24 disposed on one surface and a thick-film patch element 26 disposed on the other surface.

In one embodiment of the present invention, a single coaxial cable (not shown) is used to carry signals to/-from the antenna. The center conductor of the coaxial connector is passed through a hole 28 in dielectric layer 22 and soldered to patch element 26. The outer conductor of the coaxial connector is soldered to the bottom of reference surface 24. In this way, antenna 20 can remain in the horizontal position necessary to receive, for example, GPS signals while the receiver electronics can be in a package below antenna structure 20. It should be understood, however, that other transmission methods may be used without deviating from the scope of this description or the claims set forth herein.

In the preferred embodiment, dielectric layer 22 comprises a ceramic substrate. Such substrate should preferably exhibit as high a dielectric constant as practical, taking into account upper limits defined by lossiness requirements and substrate availability. In the latter regard, and of importance, readily available ceramic substrates can be employed in the present invention for cost reduction. For example, a 96% alumina content substrate can be readily obtained in a predrilled, "as fired condition", and directly employed (i.e., without flatness preconditioning) in the present invention.

More particularly, it should be appreciated that readily available ceramic substrates generally have not been employed in antennas, because such substrates present challenges not heretofore overcome. For example, such substrates generally comprise non-alumina components whose dielectric characteristics commonly vary between suppliers and batches therefrom. Given the sensitivity of thin-film patches, this causes impedance matching difficulties and significant losses unless extensive tuning networks are employed. Additionally, due to the processing techniques typically employed to fabricate such substrates, surface topography is far rougher than that of a higher quality ceramic. As a result of poorer topography, resistive losses can increase. In view of such challenges, it is believed that thin-film antennas cannot be practically employed for many applications. As noted, while substrate surfaces can be ground flat, each ceramic blank would have to be ground individually as an extra step in the production of the antenna, thereby adding to the cost and at least partially offsetting the cost advantage gained by using the lower quality ceramic.

The present invention substantially overcomes the noted challenges by utilizing a thick-film patch, and by positioning the patch to achieve an acceptable impedance match. For example, losses can be compensated for by placing the feed hole asymmetrically relative to the zero reactance axis of the patch element to obtain an acceptable impedance match. In the preferred embodiment, the patch is rectangular and the feed hole may, to the extent necessary, be located off of the diagonal between two opposite corners of the patch. An added advantage of such placement is that the feed holes of antennas produced from different batches of ceramic blanks can be moved slightly to compensate for variations in the dielectric constant between the batches and proper impedance matching can be maintained. It should also be appreciated that antenna patch elements need not be rectangular in shape but may have other geometries, such a elliptical, triangular or circular.

Furthermore, in the preferred embodiment of the present invention, patch element 26 includes one or more tuning tabs 30 around its perimeter. Tuning tabs 30 are used to alter the geometry of patch element 26 to adjust the resonant frequency, impedance and/or polarization of the antenna after patch element 26 has been patterned/positioned and the antenna has been fired.

Production of a single frequency antenna 20 of the present invention proceeds in the preferred embodiment as follows:

Each new batch of ceramic blanks to be employed is characterized for its dielectric constant and patch placement/tuning needs by producing one or more test antennas. Because the ceramic blanks may be predrilled for the feed hole, the position of the patch element on the ceramic blank relative to the hole is critical to its frequency of operation, polarization and impedance match. The dielectric properties of the ceramic substrate may affect all of these parameters but corrections can be made by changing the placement of the patch element relative to the predrilled feed hole. It was previously believed that the feed hole of an antenna coupled to standard feedline of, for example, 50 ohms must be located on the zero reactance axis (e.g. on the diagonal between two opposite corners of a rectangular patch) in order to properly match the antenna to the feed and to properly receive (or transmit) circularly polarized signals (e.g. right- or left-hand circularly polarized, depending upon the diagonal on which the feed hole was located). The present invention recognizes, however, that closer matching may be achieved when the feed hole is located off of the zero reactance axis to offset impedance variations and losses caused by imperfections in the antenna structure and the presence of the feed line and connection. For example, moving the feed hole in a straight line away from or toward the patch center changes the resistance of the antenna at the feed hole; moving the feed hole on an arc relative to the patch center changes the reactance.

For each batch of ceramic blanks, a series of test antennas can be produced, each time moving the patch element relative to the predrilled feed hole until the desired impedance match to the feed line (e.g. 50 ohms) can be achieved. It has been found that variations in the feed hole location of as little as 0.005 inches can affect antenna performance. Therefore, patch placement is an important step and may require printing and testing several patches. However, even if several such antennas are tested and thrown away to determine optimal placement, a single batch of ceramic blanks may include as many of 10,000 or more blanks; therefore, the number of discards is relatively small. Varying the patch location also reduces the need for defining/accommodating a separate tuning network on a per-batch basis, and reduces tab trimming demands.

Once the proper geometric position for the patch element has been found for a given batch, a full production run can be commenced. A thick film metallized paste is deposited onto one surface of the ceramic blank using conventional screening techniques to produce the patch element. The ground plane reference surface is similarly screened onto the opposite side of the blank and the entire antenna structure is dried and fired. Although one metallization surface can be dried and fired before screening the other, drying and firing both surfaces simultaneously eliminates several steps, thereby speeding the production process and reducing costs. The paste may contain one of several metals, including, for example, copper, silver, gold, platinum-silver or palladium-silver. The layer of metallized paste which is applied to the ceramic substrate should be thick enough (e.g. 0.5 mil or greater) to fill topographical imperfections in the ceramic surface, and thereby yield a substantially flat radiating element.

After a batch of antennas has been produced, they may be fine tuned, as needed, for a particular application or operating environment. As illustrated in FIG. 1, patch element 26 can be divided into eight imaginary radial sectors, labelled A through H, each having one or more tuning tabs 30. It has been found that, to adjust the resonant frequency, tuning tabs 30 in sectors A, D, E, and/or H can be trimmed with a bead blaster or laser assembly. Trimming tabs 30 in sectors C and G will create or increase the size of a resonant loop (also known as a "cusp") while trimming tabs 30 in sectors B and F will eliminate or reduce a resonant loop. Consequently, the resonant loop can be controlled without having any significant effect on the resonant frequency; similarly, the resonant frequency may be controlled without having a significant effect on the size of the resonant loop. Because of the nature of the losses and imperfections in the antenna structure and feed circuit, it has been found that tuning tabs 30 may not be trimmed in a symmetrical manner to achieve acceptable results. Use of tuning tabs 30 reduces the need for a separate tuning network in connection with the feed between the antenna and receiver or transmitter. Other tab arrangements are possible to increase or decrease the fineness and ease of tuning, including varying the number and spacing of tuning tabs 30 and varying the number and spacing of sectors.

EXAMPLE

Figure 2:
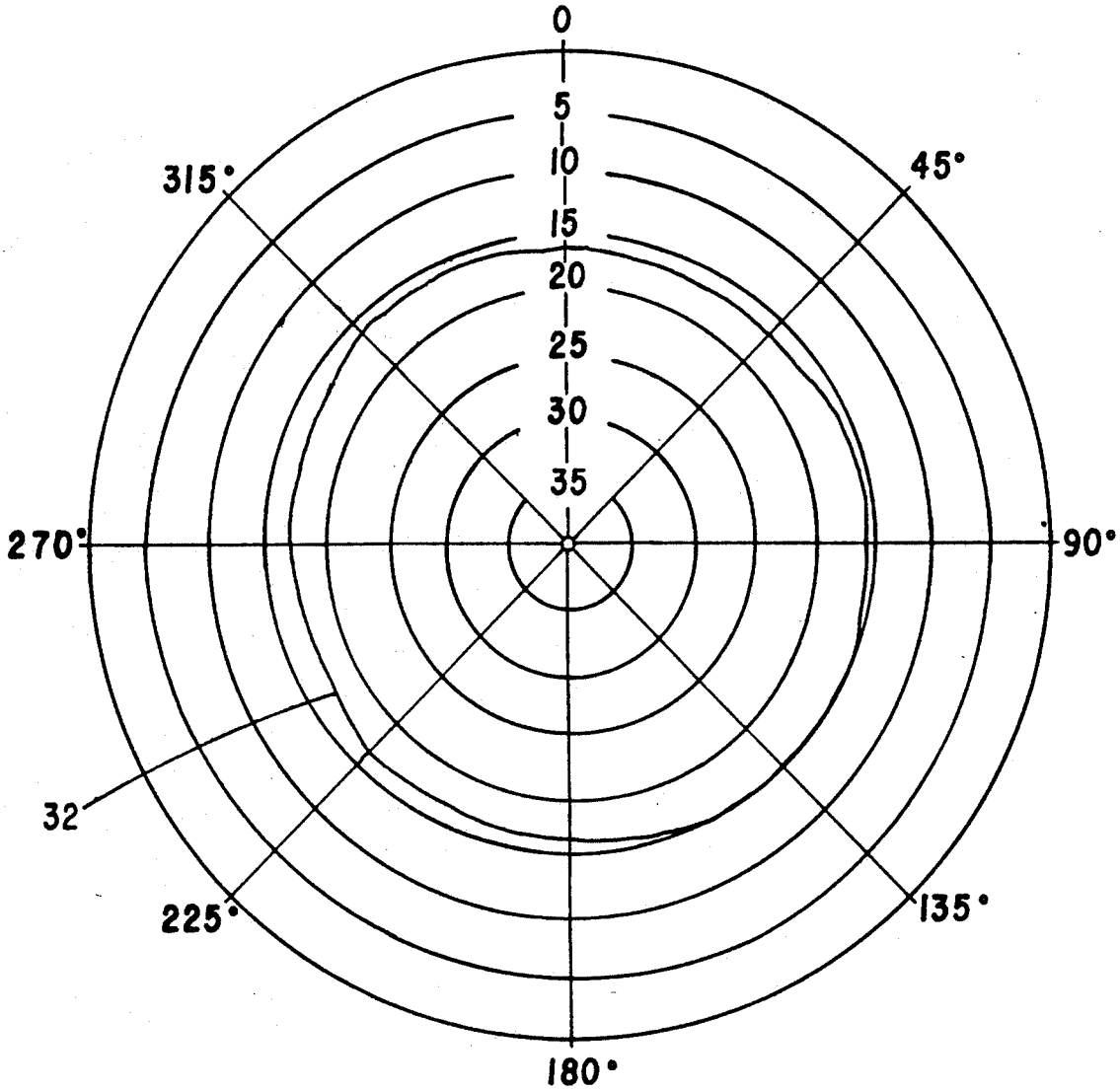
FIGS. 2–4 illustrate various radiation patterns achieved in one example of an embodiment of the present invention.
Figure 3:
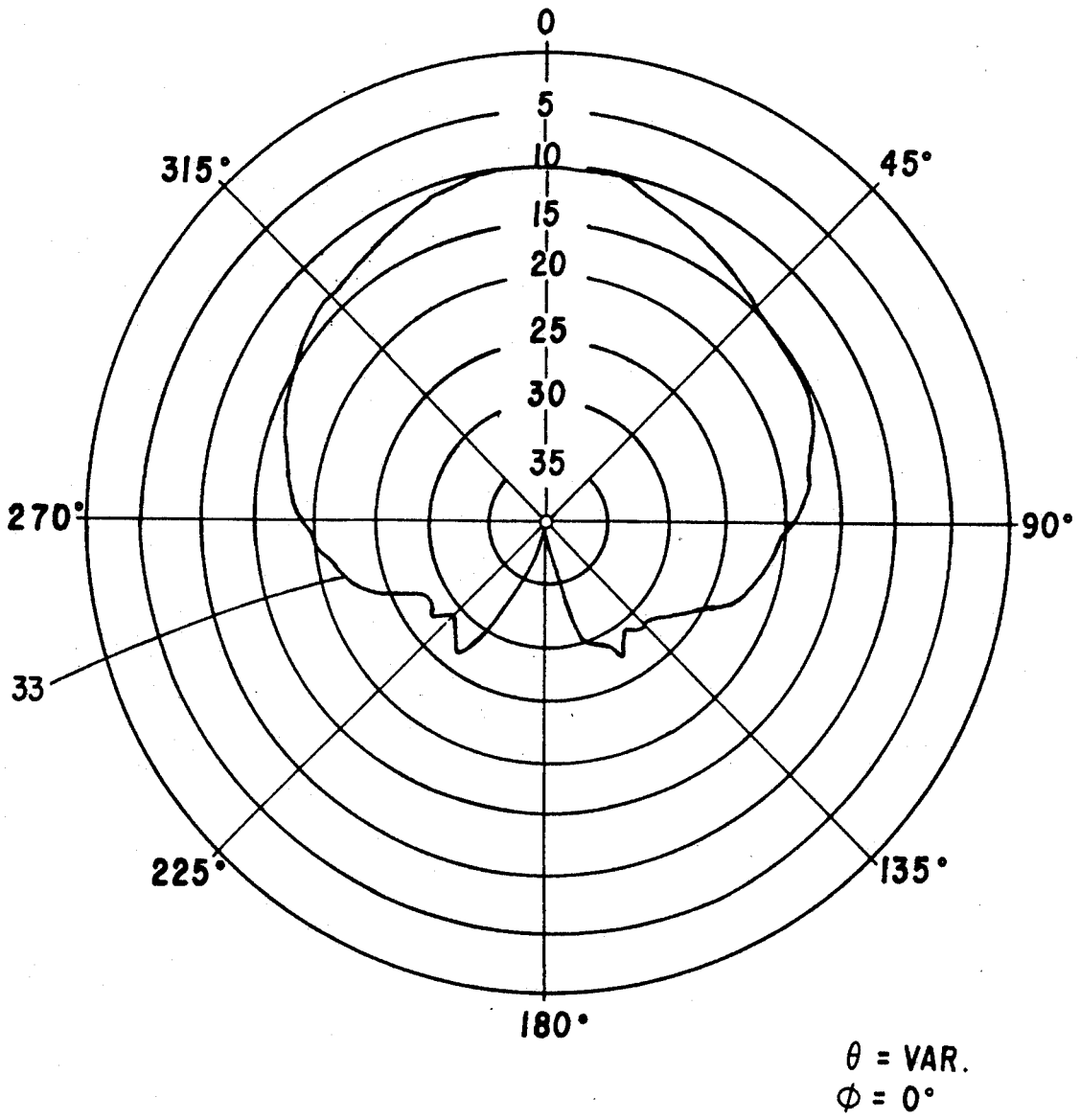
Figure 4:
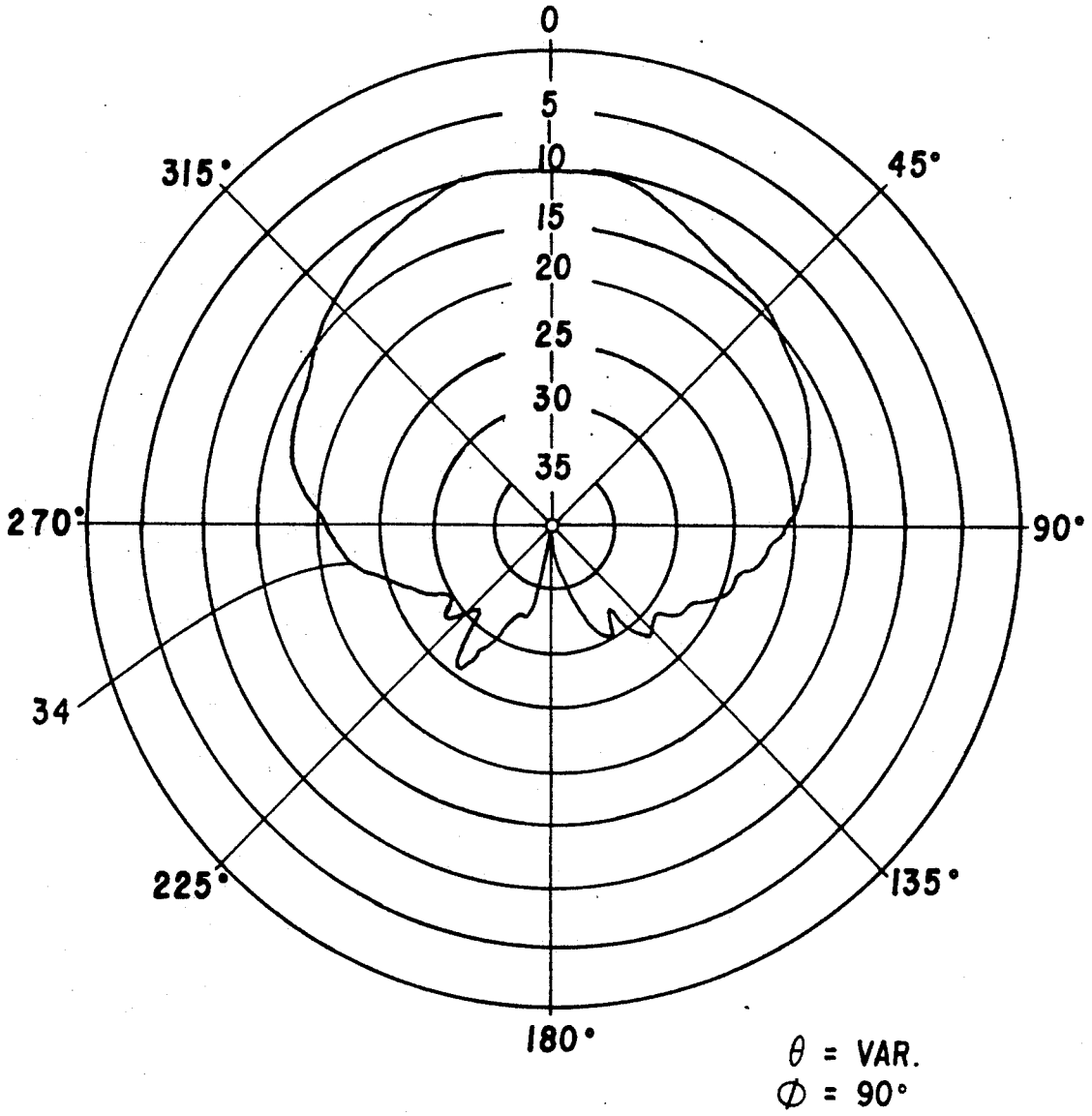

FIGS. 2–4 represent radiation patterns exhibited by a single frequency patch antenna embodiment of the present invention. The embodiment utilized a 2-in. square ceramic blank comprising approximately 96 percent alumina and having a thickness of approximately 0.1 inches. Copper paste was screened onto one entire surface of the substrate to serve as a ground plane and screened onto the other surface in the patch pattern shown in FIG. 1. The copper paste was applied to a thickness of approximately 0.7 mil, and the antenna was dried and then fired (in a nitrogen atmosphere to avoid oxidation of the copper). After firing, the metallized surfaces were cleaned and tinned to prevent oxidation which would affect antenna performance. Finally, a feed pin was soldered to the patch surface through the feed hole and attached to a coaxial connector.

The completed antenna was placed in a test chamber, connected to test instruments and subjected to microwave transmissions at a frequency of 1575 megahertz. FIG. 2 shows a plot 32 of the antenna gain as a function of direction when the microwaves were transmitted from a fixed elevation of 75 degrees. Plot 32 demonstrates a nearly constant gain in all directions.

FIG. 3 illustrates a plot 33 of the antenna gain as a function of elevation with the angle of transmission varying from directly overhead (0 degrees) to directly forward (90 degrees) to directly beneath the antenna (180 degrees) to directly behind the antenna (270 degrees) and back to directly overhead. Maximum gain occurs at 0 degrees. Low-angle gain, between about 75 degrees and about 80 degrees (or between about 15 degrees and 10 degrees elevation above the horizon), was down only approximately 7–8 dB from the maximum. Further, measurements made utilizing antennas with substantially the same physical characteristics as the antenna whose radiation patterns are illustrated in FIGS. 2–4 have similarly demonstrated satisfactory performance with peak gains of about 5 to 6 dB and low-angle (e.g., about 10–15 degrees elevation) gains of about −8 dB or greater. As will be appreciated by those skilled in the art, such achievable attributes are particularly advantageous for GPS applications.

FIG. 4 is also a plot 34 of antenna gain with respect to varying elevation but with the microwave transmission passing from directly overhead to one side to directly beneath the antenna to the opposite side and back to overhead. The pattern in FIG. 4 is very similar to that of FIG. 3, including the low angle gain which is only slight less than the low angle gain shown in FIG. 3.

Figure 5:
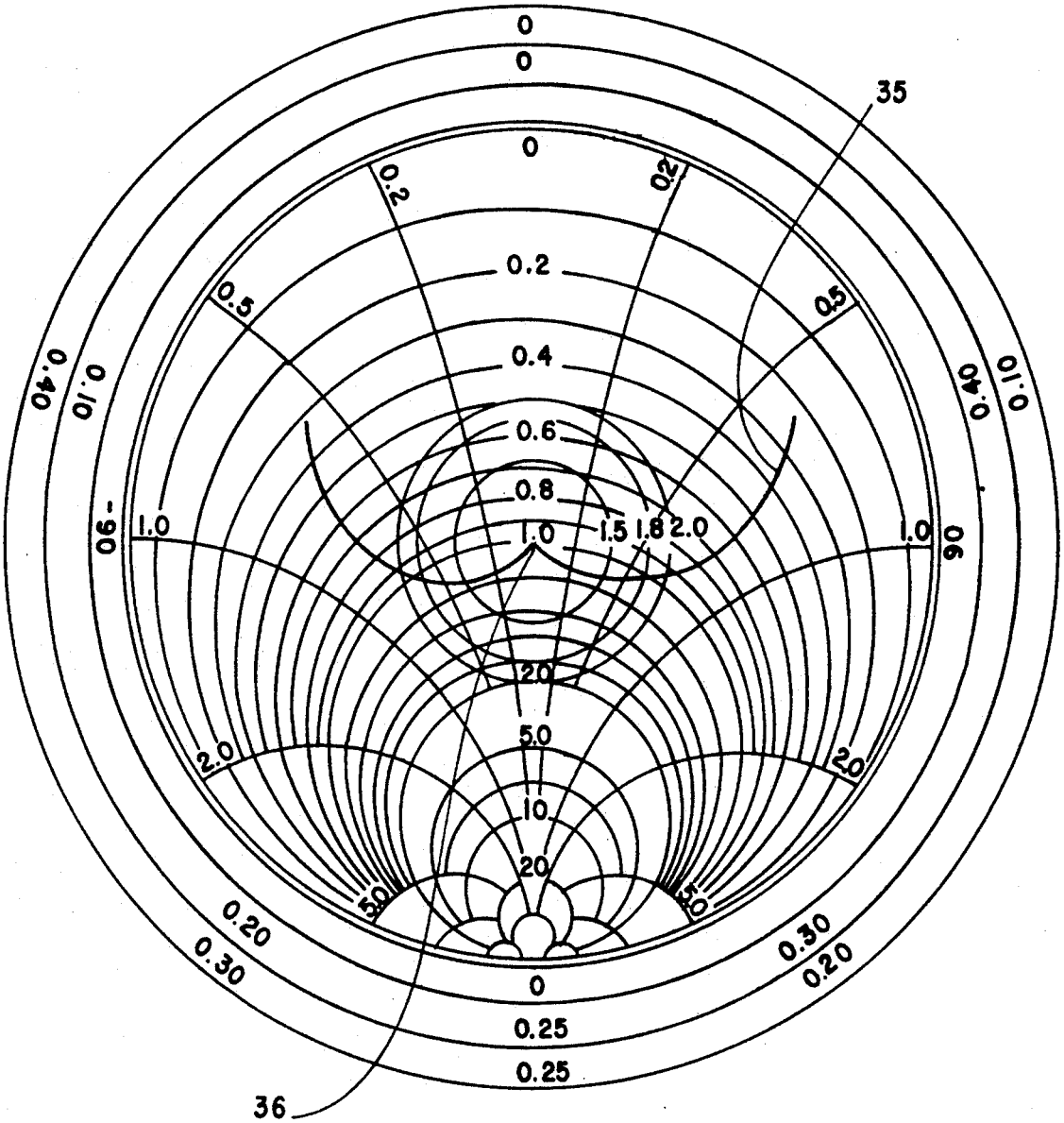
FIG. 5 illustrates a plot of impedance as a function of frequency achieved in one example of an embodiment of the present invention.

FIG. 5 illustrates a plot 35 of impedance as a function of frequency from a tuned, single frequency patch antenna of the present invention coupled to a 50 ohm transmission line. This plot shows, at 36, that, with proper patch placement relative to the fixed feed hole and with proper trimming of the tuning tabs, a nearly perfect impedance match can be achieved at a center frequency of 1575.4 MHz, and well within a VSWR of 2:1 (the industry standard for GPS applications).

Figure 6:
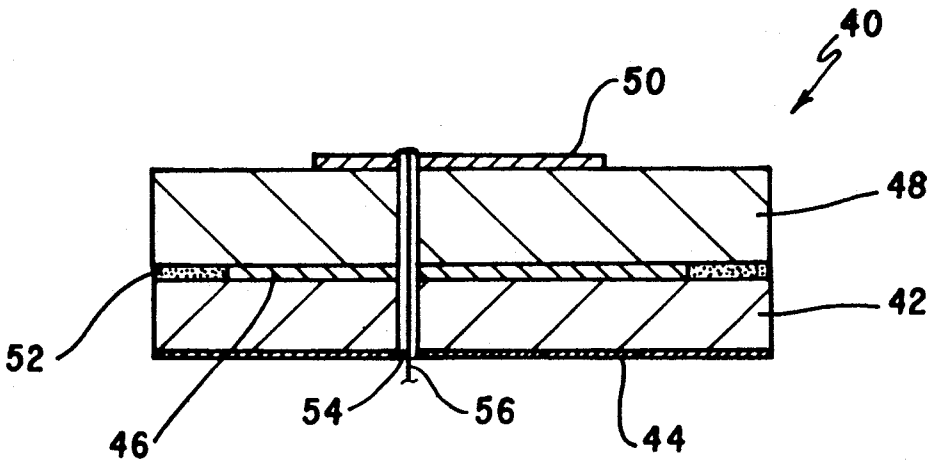
FIG. 6 illustrates a cross-sectional view of a dual frequency embodiment of the present invention and FIG. 7 illustrates an exploded perspective view of the dual frequency embodiment illustrated in FIG. 6.
Figure 7:
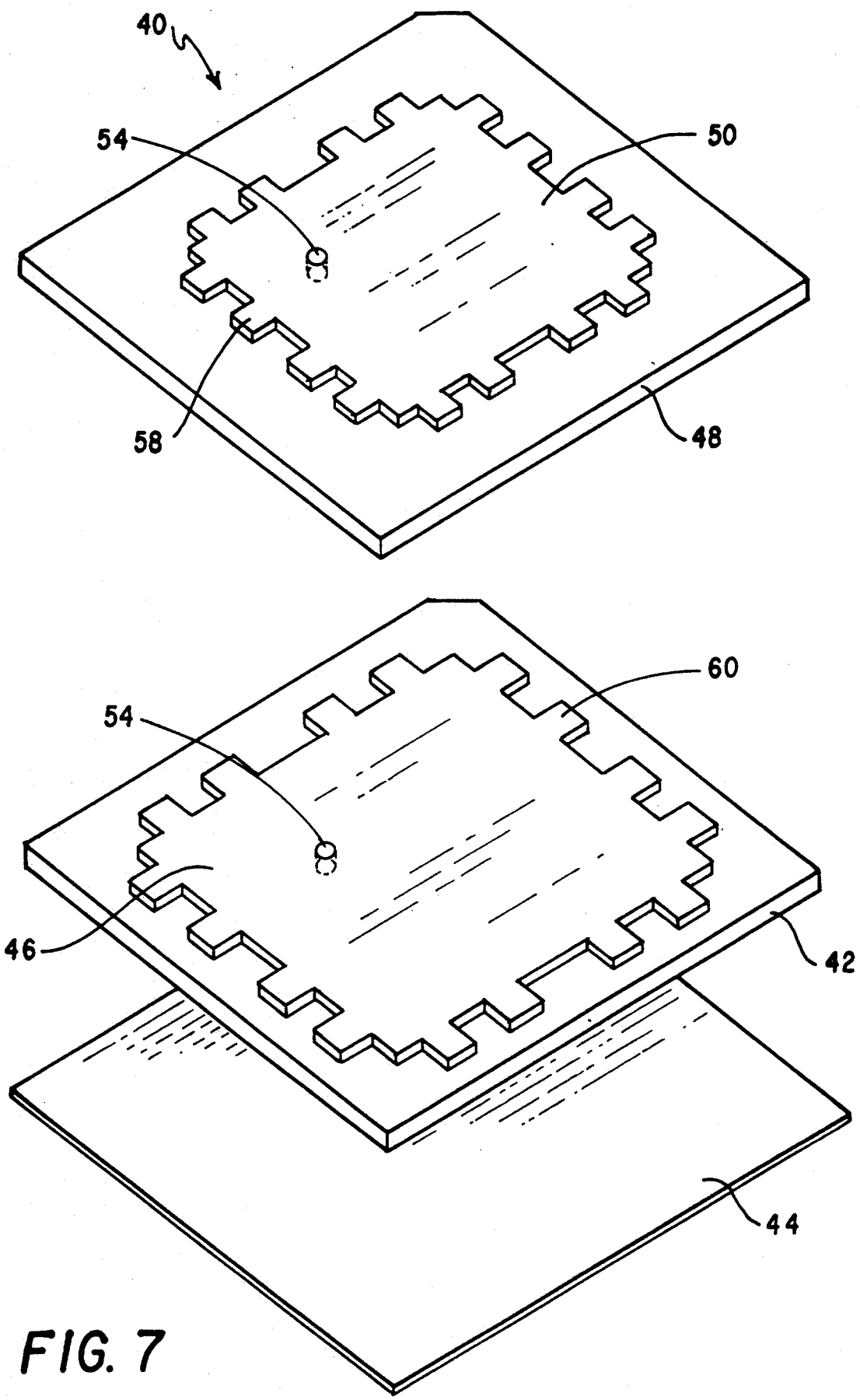

FIGS. 6 and 7 illustrate a cross-sectional view and exploded perspective view, respectively, of a dual frequency antenna 40 of the present invention. A first dielectric layer 42 separates a reference surface 44 from a first patch element 46. A second dielectric layer 48 separates first patch element 46 from a second patch element 50. The dielectric layers 42 and 48 should preferably have substantially common dielectric constants and be disposed in a substantially parallel relationship. One or more tabs 58 and 60 can be disposed around the perimeter of first and second patch elements 46 and 50, respectively, and used to alter the geometry of first or second patch elements 46 or 50, or both, to adjust the resonant frequency, impedance and/or polarization of the antenna after patch elements 46 and 50 have been patterned/positioned and the dielectric layers fired. Such alterations are made in the same manner described in conjunction with the antenna structure illustrated in FIG. 1.

Dual frequency GPS applications require bandwidths of approximately 2 MHz in the $L_1$ band and approximately 10 MHz in the $L_2$ band, with a 2:1 VSWR. For such applications, it has been found to be desirable that the thickness of first dielectric layer 42 be approximately twice that of second dielectric layer 48, the greater thickness of first dielectric layer 42 permitting the greater $L_2$ bandwidth. It should be appreciated that other applications, frequencies or bandwidth requirements may necessitate other thicknesses or other thickness ratios.

The two antenna layers are bound together by a bonding agent 52. A feed hole 54 through reference surface 44, both dielectric layers 42 and 48 and both patch elements 46 and 50 provides an opening by which a center conductor 56 of a coaxial connector (not shown) can be coupled to second patch element 50. Center conductor 56 does not come into electrical contact with reference surface 44 or with first patch element 46, but only with second patch element 50 to which it is soldered.

In operation, first and second patch elements 46 and 50 are electromagnetically coupled. Each patch element 46 and 50 is designed to operate at a particular resonant frequency, first element 46 having the lower resonant frequency because of its larger size. At the resonant frequency of first patch element 46, second patch element 50 is operating below its resonant frequency and is, therefore, coupled through electromagnetic fields to first patch element 46 by small inductive reactance. Such coupling, therefore, actually becomes a part of the feed for connecting first patch element 46 with center conductor 56. Radiation fields are then excited in a conventional fashion between first patch element 46 and ground plane 44.

At the higher resonant frequency of second patch element 50, first patch element 46 is operating above its resonant frequency and is, therefore, capacitively coupled to ground plane 44. First patch element 46 becomes an extension of ground plane 44 and conventional radiation fields are excited between second patch element 50 and first patch element 46 as an extension of ground plane 44. Again, the non-resonant element, in this case first patch element 46, has become part of the feed means for exciting the radiation fields about the resonant second patch element 50. Consequently, antenna structure 40 is operable to radiate or receive signals at two frequencies which are determined by the dimensions of first and second patch elements 46 and 50, respectively.

Any material in close proximity to a radiating element will affect the performance (resonant frequency and impedance match) of an antenna structure. Existing bonding adhesives are unsatisfactory because of their relatively low dielectric constants (in the range of 2 to 4) and inability to tolerate the high temperatures needed to fire thick-film paste on many substrates, including ceramic. They also tend to be lossy. Bonding agent 52 should preferably, therefore, be chosen to provide a good dielectric and thermal match to dielectric layers 42 and 48. For example, dielectric layers 42 and 48 may each comprise a ceramic substrate having a 96 percent alumina content and a dielectric constant of about 9.2. Correspondingly, bonding agent 52 then may comprise a low dielectric constant adhesive base blended with a high dielectric constant loading material, such as titanium dioxide (K=about 80), in such a proportion as to enable bonding agent 52 to electrically resemble dielectric layers 42 and 48 (i.e., displaying a dielectric constant of about 9.2), thereby reducing electromagnetic discontinuities in the antenna structure 40.

The adhesive base may, for example, comprise a one- or two-part urethane base, a one- or two-part epoxy base or a silicone base. Due to their dispersion attributes, it has been found that such adhesives are preferred to enhance positioning of first and second patch elements 46 and 50 in a substantially parallel relationship. Use of a two-part adhesive also permits the two parts of antenna structure 40 to be temporarily secured to each other for testing upon application of a first part of the adhesive, and separated for tuning of patch elements 46 and 50, as necessary. Thereafter, the second part of the adhesive can be applied for permanent bonding of the antenna structure 40.

As will be appreciated, antennas which are operable at more than two resonant frequencies may be constructed by stacking additional dielectric layers and patch elements onto the antenna structure. The top most patch element would be directly coupled to inner connector 56 while the lower patch elements would be electromagnetically coupled in the manner previously noted.

Although the present invention has been described in detail, it should be understood that various changes, substitutions and alterations can be made hereto without departing from the scope of the invention as defined by the appended claims.

What is claimed is:

1. A process for manufacturing an antenna structure, comprising the steps of:

providing a ceramic substrate;

silk-screening a first paste, comprising a conductive material and a binder, on a top surface of the ceramic substrate in a predetermined antenna patch configuration including a plurality of tabs about the periphery thereof;

firing the first paste to remove the binder therefrom to provide an antenna patch element having substantially the predetermined configuration on the top surface of the ceramic substrate including a plurality of tabs about the periphery thereof;

removing at least a portion of at least one of the plurality of said tabs on the periphery of said antenna patch element;

supplying a ground plane below the ceramic substrate; and interconnecting RF feed means to the antenna patch element and to the ground plane.

2. The process of claim 1, wherein said silk-screening step includes:

applying the first paste to a predetermined thickness wherein the antenna patch element has a top surface which is substantially planar and substantially parallel to a bottom surface of the ground plane.

3. The process of claim 2, wherein the predetermined thickness is at least about 0.5 mils.

4. The process of claim 2, wherein said providing step includes:

selecting a ceramic substrate having an alumina content of about 96%.

5. The process of claim 2, wherein said providing step includes:

selecting a ceramic substrate having a dielectric constant of about 9 to 10.

6. The process of claim 1, wherein said supplying step includes:

silk-screening a second paste, comprising a conductive material and a binder, on a bottom surface of the ceramic substrate to a predetermined thickness;

firing the second paste to remove the binder therefrom, whereby the ground plane has a bottom surface which is substantially planar and substantially parallel to the top surface of the antenna patch element.

7. The process of claim 6, wherein the predetermined thickness is at least about 0.5 mils.

8. The process of claim 1, wherein said removing step includes:

substantially matching the impedance of the antenna patch element with the impedance of the RF feed means.

9. The process of claim 1, wherein said removing step includes:

adjusting the resonant frequency of the antenna structure.

10. The process of claim 1, wherein said removing step includes:

substantially matching the impedance of the antenna patch element with the impedance of the RF feed means; and adjusting the resonant frequency of the antenna structure.

11. The process of claim 1, wherein:

at least one tab is provided in each of eight radial sectors around the perimeter of the antenna patch element; and said removing step includes:

removing at least a portion of at least one of the plurality of tabs in at least a first of the radial sectors to adjust the resonant frequency of the antenna structure without substantially affecting the impedance thereof; and removing at least a portion of at least one of the plurality of tabs in at least a second of the radial sectors to adjust the impedance of the antenna structure without substantially affecting the resonant frequency thereof.

12. The process of claim 1, further comprising:

tuning the antenna structure, including:

adjusting the resonant loop of the antenna structure to substantially match the resistance and reactance of the antenna patch element with the resistance and reactance of the RF feed means.

13. The process of claim 1, further comprising:

boring a feed hole through the ceramic substrate before said silk-screening step.

14. The process of claim 13, wherein said silk-screening step includes:

positioning the predetermined configuration in a predetermined location relative to the feed hole through the ceramic substrate.

15. The process of claim 14, wherein said positioning step includes:

selecting the predetermined location relative to the feed hole to enable the antenna structure to transmit/receive circularly polarized radiation.

16. The process of claim 14, wherein said positioning step includes:

selecting the predetermined location relative to the feed hole to enable the antenna structure to transmit/receive radiation having a substantially hemispherical pattern.

17. The process of claim 13, wherein said silk-screening step includes:

defining a hole through the first paste in substantial registration with the feed hole through the ceramic substrate.

18. The process of claim 17, wherein said interconnecting step includes:

passing one end of a first feed conductor through the feed hole bored through the ceramic substrate;

electrically connecting the one end of the first feed conductor to the antenna patch element; and electrically connecting one end of a second feed conductor to the ground plane.

19. The process of claim 1, wherein:

said supplying step includes:

silk-screening a second paste, comprising a conductive material and a binder, on a bottom surface of the ceramic substrate; and said firing step includes:

cofiring the first and second pastes to remove their binders.

20. A process for manufacturing a multiple frequency antenna, comprising the steps of:

providing a bottom ceramic substrate and at least a top ceramic substrate;

boring a feed hole through each ceramic substrate;

silk-screening a first paste, comprising a conductive material and a binder, on a top surface of the bottom ceramic substrate in a first predetermined configuration and in a first predetermined location relative to the feed hole therethrough;

silk-screening a second paste, comprising a conductive material and a binder, on a top surface of the at least top ceramic substrate in at least a second predetermined configuration and in at least a second predetermined location relative to the feed hole therethrough;

firing the first paste silk-screened on the bottom ceramic substrate to remove the binder therefrom to provide a first antenna patch element having substantially the first predetermined configuration;

firing the second paste silk-screened on the at least top ceramic substrate to remove the binder therefrom to provide a second antenna patch element having substantially the at least second predetermined configuration;

supplying a ground plane below the bottom ceramic substrate;

bonding the bottom and at least top ceramic substrates together, wherein the feed hole through the bottom ceramic substrate is in substantial registration with the feed hole through the at least top ceramic substrate, and wherein the first antenna patch element is substantially parallel to the second antenna patch element; and interconnecting a single RF feed means to the antenna patch element on the top ceramic substrate and to the ground plane, said interconnecting step including:

passing one end of a first feed conductor through the feed holes bored through the bottom and at least top ceramic substrates;

electrically connecting the one end of the first feed conductor to the antenna patch element on the top surface of the top ceramic substrate; and electrically connecting one end of a second feed conductor to the ground plane.

21. The process of claim 20, wherein said providing step includes:

selecting ceramic substrates having substantially the same dielectric constant.

22. The process of claim 21, wherein said bonding step includes:

selecting a bonding agent having a dielectric constant which substantially matches the dielectric constant of the ceramic substrates.

23. The process of claim 22, wherein said bonding step further includes:

selecting a bonding agent having titanium dioxide in an adhesive base.

24. The process of claim 20, wherein said supplying step includes:

silk-screening a third paste, comprising a conductive material and a binder, on a bottom surface of the bottom ceramic substrate to a predetermined thickness whereby the ground plane has a bottom surface which is substantially planar and parallel to the antenna patch element on the top surface of the bottom ceramic substrate.

25. The process of claim 24, further comprising:

cofiring the first and third conductive pastes silk-screened on the top and bottom surfaces of the bottom ceramic substrate to remove the binders therefrom.

26. The process of claim 20, further comprising:

tuning each antenna patch element, comprising:

removing at least a portion of at least one of a plurality of tabs silk-screened around the perimeter of each antenna patch element during said silk-screening steps.

27. A process for manufacturing a plurality of antenna structures, comprising the steps of:

providing a plurality of at least first ceramic substrates, all of said first ceramic substrates having substantially the same first dielectric constant and substantially the same first predetermined dimension;

boring a feed hole through each first ceramic substrate at substantially the same first position;

silk-screening, after said boring step, a first paste, comprising a conductive material and a binder, on a top surface of each first ceramic substrate in a first predetermined configuration and in a first predetermined location relative to the feed hole therethrough;

firing the first paste to remove the binder therefrom to provide a plurality of first antenna patch elements, each having substantially the first predetermined configuration on the top surface; and supplying a ground plane below each first ceramic substrate.

28. The process of claim 27, wherein said silk-screening step includes:

defining a plurality of tabs as part of and around the perimeter of said first predetermined configuration.

29. The process of claim 28, further comprising:

tuning at least one of said first antenna patch elements, comprising:

removing at least a portion of at least one of the plurality of said tabs on the periphery of said at least one first antenna patch elements.

30. The process of claim 27, wherein said silk-screening step includes:

applying the first paste to a predetermined thickness whereby each first antenna patch element has a top surface which is substantially planar and parallel to a bottom surface of the corresponding ground plane.

31. The process of claim 30, wherein the predetermined thickness is at least about 0.5 mils.

32. The process of claim 30, wherein said providing step includes:

selecting first ceramic substrates having an alumina content of about 96%.

33. The process of claim 27, wherein said providing step includes:

selecting first ceramic substrates having a dielectric constant of about 9 to 10.

34. The process of claim 27, further comprising:

interconnecting RF feed means to each first antenna patch element and to the ground plane below each first ceramic substrate, said interconnecting step including:

passing one end of a first feed conductor through the feed hole bored through each first ceramic substrate;

electrically connecting the one end of the first feed conductor to the first antenna patch element on the top surface of each ceramic substrate; and electrically connecting one end of a second feed conductor to each ground plane.

35. A process of manufacturing a plurality of antenna structures comprising:

providing a plurality of at least first ceramic substrates having substantially the same first dielectric constants and substantially the same first predetermined dimensions;

boring a feed hole through each first ceramic substrate at substantially the same first position;

silk-screening a first paste, comprising a conductive material and a binder, on a top surface of each first ceramic substrate in a first predetermined configuration and in a first predetermined location relative to the feed hole therethrough;

firing the first paste to remove the binder therefrom to provide a plurality of first antenna patch elements, each having substantially the first predetermined configuration on the top surface;

supplying a ground plane below each first ceramic substrate;

providing a plurality of second ceramic substrates having substantially the same second dielectric constants and substantially the same second predetermined dimensions;

boring a feed hole through each second ceramic substrate at substantially the same second position;

silk-screening a second paste, comprising a conductive material and a binder, on a top surface of each second ceramic substrate in a second predetermined configuration and in a second predetermined location relative to the feed hole therethrough;

firing the second paste to remove the binder therefrom to provide a plurality of second antenna patch elements, each having substantially the second predetermined configuration on the top surface;

bonding each first ceramic substrate to a second ceramic substrate, wherein the feed hole through each first ceramic substrate is in substantial registration with the feed hole through the corresponding second ceramic substrate, and wherein each first antenna patch element is substantially parallel to the corresponding second antenna patch element; and interconnecting RF feed means to each second antenna patch element and to the ground plane below each first ceramic substrate, said interconnecting step including:

passing one end of a first feed conductor through the feed hole bored through each first and second ceramic substrate;

electrically connecting the one end of the first feed conductor to the second antenna patch element on the top surface of each second ceramic substrate; and electrically connecting one end of a second feed conductor to each ground plane.

* * * * *